United States Patent [19]

Ton-That et al.

[11] Patent Number: 4,935,687

[45] Date of Patent: Jun. 19, 1990

[54] ELECTRICAL HEAT EXCHANGE DEVICE

[75] Inventors: Ouoc-Anh Ton-That, Montreal; Daniel Maure, Varennes; Jacques Frate, Otterburn Park, all of Canada

[73] Assignee: Hydro-Quebec, Montreal, Canada

[21] Appl. No.: 242,800

[22] Filed: Sep. 12, 1988

Related U.S. Application Data

[63] Continuation-in-part of Ser. No. 110,870, Oct. 21, 1987, abandoned.

[51] Int. Cl.[5] ..... F24H 3/00

[52] U.S. Cl. ..... 219/376; 219/307; 338/57; 338/58

[58] Field of Search ..... 219/374, 375, 376, 381, 219/382, 307, 205, 206, 207; 338/206, 208, 55, 56, 57, 58

[56] References Cited

U.S. PATENT DOCUMENTS

| | | | |
|---|---|---|---|
| 2,084,556 | 6/1937 | Hamilton | 338/206 |
| 2,570,692 | 10/1951 | Knight | 338/206 |
| 3,244,860 | 4/1966 | Lindley | 219/382 |
| 3,344,257 | 9/1967 | Moller | 219/381 |
| 4,025,794 | 5/1975 | Marzonne et al. | 219/381 |
| 4,491,118 | 1/1985 | Woddridge | 219/206 |
| 4,521,674 | 6/1985 | Scanlan et al. | 219/365 |
| 4,713,524 | 12/1987 | Leo et al. | 219/382 |

*Primary Examiner*—A. D. Pellinen
*Assistant Examiner*—Jeffrey A. Gaffin
*Attorney, Agent, or Firm*—Oblon, Spivak, McClelland, Maier & Neustadt

[57] ABSTRACT

An electrical heat exchange device comprising a plurality of electrically conductive metal plates secured side by side in spaced apart relationship by electrically insulating spacer means. Each of the plates has a plurality of conductive path sections formed therein so that current will flow along a predetermined elongated path through the plate. The plates have a plurality of perforations, at least along the elongated path for the passage of a fluid conducted therethrough under pressure whereby to heat the fluid by the plurality of plates. The perforations decrease the conductive cross-section area thereby increasing the electrical resistance of the plate. Electrical connectors are provided for connecting the plates in series with one another at opposed ends of the elongated path. Connectors are provided for connecting the series of plates to an electrical power source for heating the plates by joule effect.

9 Claims, 2 Drawing Sheets

ELECTRICAL HEAT EXCHANGE DEVICE

This application is a continuation-in-part of the copending U.S. patent application Ser. No. 07/110,870, filed on Oct. 21, 1978, abandoned.

BACKGROUND OF THE INVENTION

1. Field of the Invention

The present invention relates to an improved electrical heat exchange device comprising a plurality of electrically conductive metal plates connected in series and through which a fluid to be heated is passed under pressure. Particularly, each conductive plate defines a long conductive path for the current, the length of which is predetermined depending on the various power voltage level that the device must be connected.

The electrical heat exchange device of the present invention was particularly developed to replace other electrical heating devices used to heat liquids or air forced therethrough. The electrical heat exchange device of the present invention is particularly useful in applications where a high power density is required, where fluid is required to be quickly heated, where the heating requires high temperatures, and where the heating device must utilize a minimum amount of space and be constructed at a minimum investment cost.

2. Description of Prior Art

Various types of electrical heat exchange devices are known such as open coiled type electrical heating elements, tubular type electrical heating elements, or screen type elements. However, these elements have various disadvantages. For example, open coiled type electrical heating elements have a volumetric power density factor of the order of 10 watts per $cm^3$ with an air speed of 10 meters/second. Also, at this density, the increase in temperature of the fluid being heates is very limited in a reasonable heating volume.

Some porous electrical elements are known and these are usually fabricated from ceramic, carbon, etc. whichis relatively weak. Such heating elements have been found to be difficult and costly to build. One of the disadvantages of these elements is that it requires more pressure to move a fluid therethrough than other types of electrical heating elements for the same power transfer. In U.S. Pat. No. 3,344,247 there is disclosed an electrically powered fluid heater consisting of a plurality of metal screen sections positioned in spaced apart side-by-side relationship. The screen sections are held in a non-paralell curved fashion by supports and therefore the perforations in the screen sections are not aligned, and this creates deviations to air flow and results in pressure loss. Also, the resistance of the screen is very low as the conductive surface is the entire width and surface of the screen. Therefore the resistance, due to the nature of the conductive wire mesh, is very low because of the high electrical conductivity of the screen. The only parameter that may be modified to increase the electrical resistance for adaptation to standard voltage sources is to increase the number of screen sections. The disadvantage here is that the size of the housing may have to be made very large and impractical thereby decreasing the volumeric power density ($Kw/meter^3$). Also, there is a larger fluid flow pressure loss due to the increased number of screen sections and finally the overall cost of the heater is increased. Therefore, such devices have only limited applications and cannot be used for high power density applications at the appropriate voltage.

As an example of the most recent prior art available, reference is made to the following publications: "Nouvelles Technologies", Journal Francais de l'Electrothermie No 1 A/s 1986, Pierre Faucher. "Porous Element Fluid Heating", IEEE Coloquium on Electroheat, London 1981, J. F. Pollock. "Processing of Liquids Using Porous Element Heaters", 10th Congress on Electroheat, Stockholm 1984, R. G. P. Kusay.

SUMMARY OF INVENTION

It is a feature of the present invention to provide an electrical heat exchange device which substantially overcomes the above disadvantages of the prior art.

Another feature of the present invention is to provide an electrical heat exchange device which permits an increase in the power density, which permits a reduction in the heating space requirement, which provides an increase in the heating temperature and a reduction of the heating time of the fluid being forced through the heating device under pressure and at a relatively low cost.

Another feature of the present invention is to provide an electrical heat exchange device which is simple to construct and adapt to different power densities, and has a long life.

According to the above features, from a broad aspect, the present invention provides an electrical heat exchange device comprising a plurality of electrically conductive metal plates secured side by side in spaced apart relationship by electrically insulating spacers. Each of the plates has a plurality of conductive path sections formed therein so that current will flow along a predetermined elongated path through the plate. The plates have a plurality of perforations, at least along the elongated path, for the passage of a fluid convected therethrough under pressure whereby to heat the fluid by the plurality of plates. The perforations decrease the conductive cross-section area thereby increasing the electrical resistance of the plate. Electrical connectors are provided for connecting the plates in series with one another at opposed ends of the elongated path. Connectors are provided for connecting the series of plates to an electrical power source for heating the plates by joule effect.

According to a further broad aspect of the present invention the conductive path sections are straight metal plate sections disposed in side by side parallel relationship across the plate, and each interconnected at an opposed common end thereof.

According to a further broad aspect of the present invention the conductive path sections are formed by elongated slits formed in opposed parallel straight edges of each of the plates in an alternating sequence with each of the slits terminating a predetermined distance from its opposed plate straight edge to constitute a connecting end section with an opposite conductive path section.

According to a further broad aspect of the present invention the resistance of the conductive metal plate can be modified by severing one or more of the conductive path sections whereby to adapt the heat exchange device to a predetermined power source level rating.

BRIEF DESCRIPTION OF DRAWINGS

A preferred embodiment of the present invention will now be described which reference to the accompanying drawings in which.

DESCRIPTION OF PREFERRED EMBODIMENTS

Figure 1:
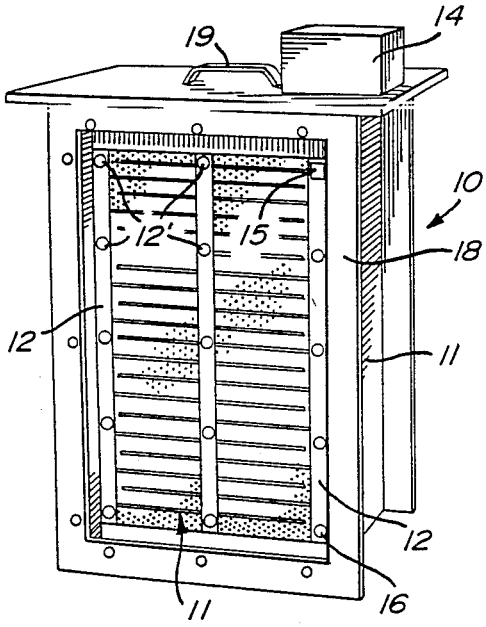
FIG. 1 is a perspective view of an electrical heat exchange device constructed in accordance with the present invention.
Figure 2A:
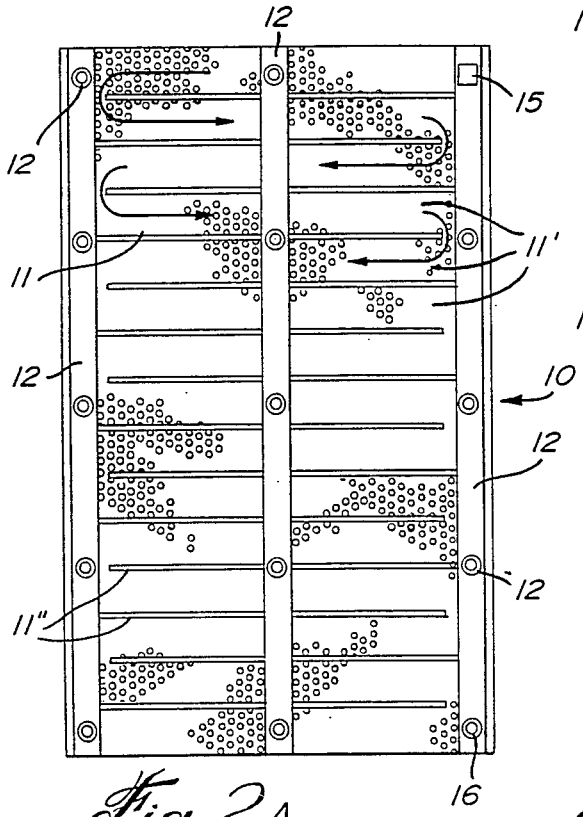
FIGS. 2A, 2B and 2C are a plan view, a side view, and a top view, respectively, showing the construction of a stack of electrically conductive metal plates utilized in a heat exchange device constructed in accordance with the invention.
Figure 2B:
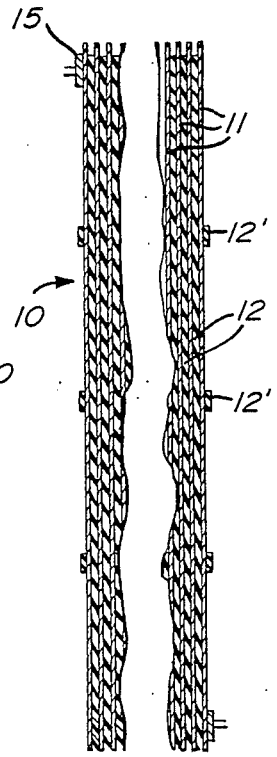
Figure 2C:
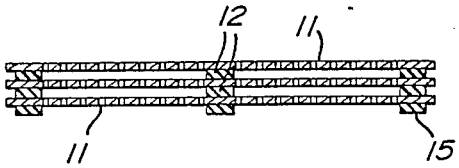

Referring now to the drawings, and more particularly to FIGS. 1 and 2A to 2C, there is shown generally at 10 a heat exchange device constructed in accordance with the present invention and comprising a plurality of electrically conductive metal plates 11 which are secured side by side in spaced parallel relationship by electrically insulating securement spacer strips 12 held by insulating connectors 12'. As herein shown, there are a plurality of spacer strips 12 provided in vertical rows and these are connected between adjacent ones of the plates as illustrated in FIGS. 2B and 2C. The spacers could also be small ceramic discs or plates secured between the plates or other insulating spacer means.

Figure 3:
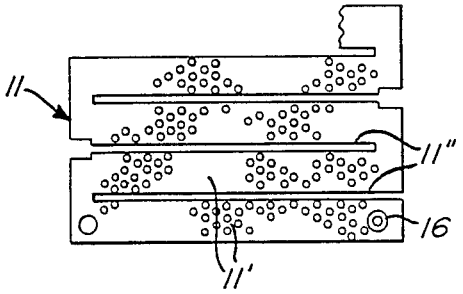
FIG. 3 is a fragmented plan view of one of the conductive metal plates.
Figure 4:
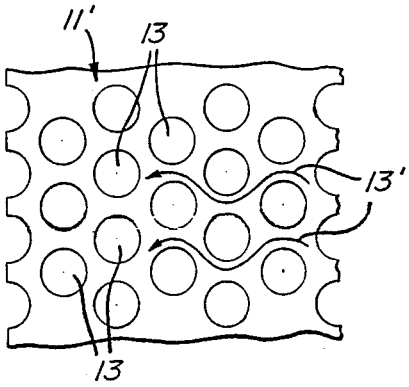
FIG. 4 is an enlarged fragmented plan view of a portion of an electrical conductive path section of the perforated metal plate showing the configuration of the perforations or conductive path.

As shown more clearly in FIGS. 2A and 3, each of the plates 11 are provided with a plurality of conductive path sections 11' formed by setting the plate from opposed edges in an alternating fashion, as shown by slits 11''. Accordingly, the conductive path is greatly increased by making the current flow in a side by side manner from the opposed end of each plate. Still further, the sections 11' have a plurality of perforations 13, herein configured as circular holes, spaced apart in parallel rows with the circular perforations of adjacent rows being offset from one another. As herein shown, they are offset ½ the distance between the holes of each row. The perforations decrease the conductive cross-section area thereby increasing the electrical resistance of the plate. Accordingly, as can be appreciated with this plate configuration, it is possible to adapt the plates to various power voltage levels by severing the plates along the slots to the desired conductive length (current path length) thereby modifying the resistance of the plate to suit the power voltage level of the supply source. It should also be noted that the resistance of the plates can also be altered by modifying the size and configuration of the perforations and the width of each conductive path section 11'. Thus, the number of plates is not altered and the fluid flow pressure is not affected when adapting the heater to a power source of a different level rating.

The heat exchange device 10 is usually secured in a fluid convection duct or passageway whereby to heat the fluid which is forced by pressure through the perforations 13 in these plates. The fluid, being air, gas or liquid, passes through these plates through the perforations 13 to extract heat from the metal plates. The plates are heated by connecting an electrical power source 14 thereto. The power source 14 is connected to power terminal 15 and all the plates are in a corner of a plate 11 at the end of the series of conductive path sections connected in series with one another by electrical connectors 16 disposed in adjacent corners of each juxtaposed plates. By passing the current through the conductive path sections 11' of the plates, the plates are heated by joule effect. The plates 11 may be constructed of stainless steel, Inconel TM or any suitable conductive metal. About 50% of the plate surface area is hereinshown as being perforated to provide good heat exchange.

As shown in FIG. 1, the plates 11 are held in a frame 18 having a handle 19 secured at one end thereof whereby to slidingly insert the frame and metal plates across a fluid conduit (not shown), but obvious to a person knowledgeable with convection systems.

An advantage of utilizing a heat exchange device using perforated metal plates made of a series of conductive path sections is that these provide a very large exposed heat exchange surface in a minimum volume as compared to other known devices of the prior art, such as open coiled heating elements, tubular heating elements or screens. By directly heating these perforated metal plates by passing an electrical current therethrough along a plurality of conductive and perforated paths, it is possible to obtain super heating plates capable of raising the temperature of various fluids passed therethrough. With such heating plates, we obtain electrical heating elements which possess a very high power density to heat fluid at very high temperatures in a small volume of space. Tests have been conducted with heating elements constructed in accordance with the present invention and have shown very good results when comparing the thermal exchange coefficient and the pressure loss of the heated fluid. The results have been compared to those achieved by using conventional open coiled electrical heating elements or tubular type heating elements. The prior art porous elements, however, require much more wattage to pump the fluid through them than other types of heating elements having the same thermal transfer characteristic.

The length of the conductive path in each of these perforated plates, as well as the number of plates utilized in a frame, is determined by the power requirements and the maximum temperature rating of the material utilized to construct these plates.

The tests effected with the electrical heat exchange device of the present invention have identified that various parameters affect the thermal efficiency or heat transfer of the device and notably, the configuration and size of the perforations, the thickness of the plates, and the spacing between the plates.

These tests were achieved with a device constructed in accordance with the following specifications. The device consisted of 9 metal plates constructed of perforated steel with each plate having a dimension of 250 mm×381 mm. The thickness of the plates was 0.14 mm. The perforated holes had a diameter of 4.76 mm and the conductive surface was in the order of 51% of the total plate surface area. The plates were separated by a distance of 1.59 mm by three phenolic spacers. The spacers were 12.70 mm×381 mm and disposed horizontally or parallel as shown in FIGS. 1 and 2. The connectors were made of copper and were of the same thickness as the spacers. They were disposed at each of the corners of the plates in order to serially connect all nine plates.

The exposed surface of each plate contained 2,770 perforations and was 0.13 $m^2$ in surface area. This surface is reduced to 0.11 $m^2$ when taking into account the obstruction of the surface caused by the spacers. The results were compared with the results obtained with open coiled type heating elements having a wire diameter of 1.29 mm and a coil diameter of 5.0 mm, a pitch of 3.9 mm, and a transverse spacing of 15 l mm. These were also compared with tubular elements having a diameter of 10.92 mm and a transverse spacing of 22 mm.

It can be observed that the volumetric heat transfer surface in $m^2$ over $m^3$ of these open coiled and tubular elements, having the specific characteristics as above described, was in the order of 35.0 and 60.0, respectively, as compared to those of the porous element of the present invention which were 500.0.

An analysis of the results of these tests has shown that the heat transfer coefficient of the porous element or porous plates of the present invention is generally larger than that of the spiral or tubular elements, particularly at air speed of 5.0 m/s where the difference becomes increasingly larger with the air speed. The capacity of heat transfer of the porous element is particularly impressive when we observe the volumetric heat transfer rate in $Kw/m^3/C.$, that combines at the same time the coefficient H in $Kw/m^2/C.$ and the volumeric heat transfer surface in $m^2/m^3$. It is pointed out that for the same heating space, and for the same temperature range between the heating element and the air and at an air speed of 5.0 m/s, the porous element can transfer 26 times more energy than the tubular elements and 16 times more energy than the open coiled element. When the speed of the air is increased to 10.0 m/s this relationship of the volumeric heat transfer increases to 36 and 20 times more than the tubular and open coiled heating elements, respectively. However, the loss in pressure of a porous element increases rapidly with the increase of air speed. This pressure loss is more sensitive to speed than the heat transfer.

It is within the ambit of the present invention to cover any obvious modifications of the preferred embodiment described therein, provided such modifications fall within the scope of the appended claims.

We claim:

1. An electrical heat exchange device comprising a plurality of electrically conductive metal plates secured side by side in spaced parallel relationship by electrically insulating spacer means, each said plate having a plurality of conductive path sections formed by straight metal plate sections disposed in side-by-side parallel relationship across said plate and each interconnected at an opposed common end thereof so that current will flow along a predetermined elongated path through said plate, said conductive path sections being formed elongated slits disposed in opposed parallel straight edges of each said plate in an alternating sequence, each said slit terminating a predetermined distance from its opposed plate straight edge to constitute a connecting end section with an opposite conductive path section, said plates having a plurality of perforations, at least along said elongated path, for the passage of a fluid convected therethrough under pressure whereby to heat said fluid by said plurality of plates; said perforations decreasing the conductive cross-section area of said plates thereby increasing the electrical resistance of said plates, electrical connectors for connecting said plates in series with one another at opposed ends of said elongated path, and connectors for connecting said series of plates to an electrical power source for heating said plates by joule effect.

2. A heat exchange device as claimed in claim 1 wherein said metal plates are secured in parallel spaced relationship and at a predetermined distance from one another to achieve optimum heat exchange.

3. A heat exchange device as claimed in claim 2 wherein said perforations are circular holes.

4. A heat exchange device as claimed in claim 3 wherein said holes are formed in parallel rows with the holes of adjacent rows being offsett from one another.

5. A heat exchange device as claimed in claim 1 wherein each said plate has a conductive surface in the ordr of about 50% of the total surface area of said plate.

6. A heat exchange device as claimed in claim 1 wherein said spacer means comprises a plurality of ceramic spacers.

7. A heat exchange device as claimed in claim 1 wherein said spacers are constructed of phenolic material.

8. A heat exchange device as claimed in claim 1 wherein said metal plates are secured in a support frame, said support frame being retained across a fluid conduit for heating a fluid passed therethrough under pressure.

9. A heat exchange device as claimed in claim 1 wherein the quantity of said plurality of plates and the total length of said comductive path sections are proportional to the power level rating of said power source and the temperature rating of said metal plates, the resistance of each said plate being adjustable by severing a predetermined number of said conductive path sections to decrese the current path length of said plates to adapt said device to a predetermined power source level.

* * * * *